United States Patent [19]

Bedell et al.

[11] 4,201,587

[45] May 6, 1980

[54] GRAFT COPOLYMERS AS DIFFUSION CONTROL LAYERS IN PHOTOGRAPHIC DIFFUSION TRANSFER PRODUCTS

[75] Inventors: Stanley F. Bedell, Andover; Charles I. Sullivan, Melrose; Lloyd D. Taylor, Lexington, all of Mass.

[73] Assignee: Polaroid Corporation, Cambridge, Mass.

[21] Appl. No.: 942,489

[22] Filed: Sep. 15, 1978

[51] Int. Cl.[2] ..... G03C 1/76; G03C 1/40; G03C 1/48; G03C 5/54

[52] U.S. Cl. ..... 430/224; 428/522; 430/541; 430/559; 430/564; 430/566; 430/641; 430/642

[58] Field of Search ..... 96/77, 73, 74, 67, 29 D, 96/114, 119 R, 76 R; 428/522

[56] References Cited

U.S. PATENT DOCUMENTS

| | | | |
|---|---|---|---|
| 3,362,819 | 1/1968 | Land | 96/77 |
| 3,709,690 | 1/1973 | Cohen et al. | 96/114 |
| 4,120,727 | 10/1978 | Fitzgerald | 96/114 |

OTHER PUBLICATIONS

"Elimination and. . ." Crosby and Stirling, *J. Chem. Soc.* (B) 1970, pp. 671–679.

"Reactomer Acrylic Monomer RC-100 Cyanoethyl Acrylate" *Techn Reference Manual,* Thiokol/Chem. Div. Trenton, N.J.

*Primary Examiner*—Richard L. Schilling

*Attorney, Agent, or Firm*—Louis G. Xiarhos; Esther A. H. Hopkins

[57] ABSTRACT

A $\beta$-eliminating graft copolymer useful as a diffusion control layer in film units adapted for diffusion transfer processes is disclosed.

59 Claims, 4 Drawing Figures

GRAFT COPOLYMERS AS DIFFUSION CONTROL LAYERS IN PHOTOGRAPHIC DIFFUSION TRANSFER PRODUCTS

The present invention relates to photography and particularly to products adapted for employment in forming photographic diffusion transfer images.

The primary object of the present invention is to provide novel diffusion control layers comprising graft copolymers for use in photographic diffusion transfer processes.

Another object of the present invention is to provide novel image-receiving elements, particularly adapted for employment in photographic diffusion transfer products and processes and which include a graft copolymer material comprising monomeric compounds capable of undergoing $\beta$-elimination in an alkaline environment and hydrophobic comonomeric compounds each grafted onto an organic polymeric backbone.

A still further object of the present invention is to provide a novel image-receiving element particularly adapted for employment in photographic diffusion transfer color processes, which comprises a composite structure which includes, in sequence, a support layer; a polymeric acid layer; an alkali solution permeable graft copolymeric layer having specified permeability characteristics; and a dyeable polymeric image-receiving layer.

Another object is to provide a photosensitive element for photographic diffusion transfer processes which photosensitive element comprises an interlayer or overcoat comprising a graft copolymeric material having predetermined permeability characteristics.

A still further object is to provide an overcoat for an image-receiving element, said overcoat comprising a graft copolymeric material comprising monomeric units capable of undergoing $\beta$-elimination in an alkaline environment and hydrophobic comonomeric units grafted onto an organic polymeric backbone.

Other objects of the invention will in part be obvious and will in part appear hereinafter.

The invention accordingly comprises the products possessing the features, properties and the relation of components which are exemplified in the following detailed disclosure, including the drawings hereof, and the scope of the application of which will be indicated in the claims.

For a fuller understanding of the nature and objects of the invention, reference should be had to the following detailed description taken in connection with the accompanying drawings, wherein.

Figure 1:
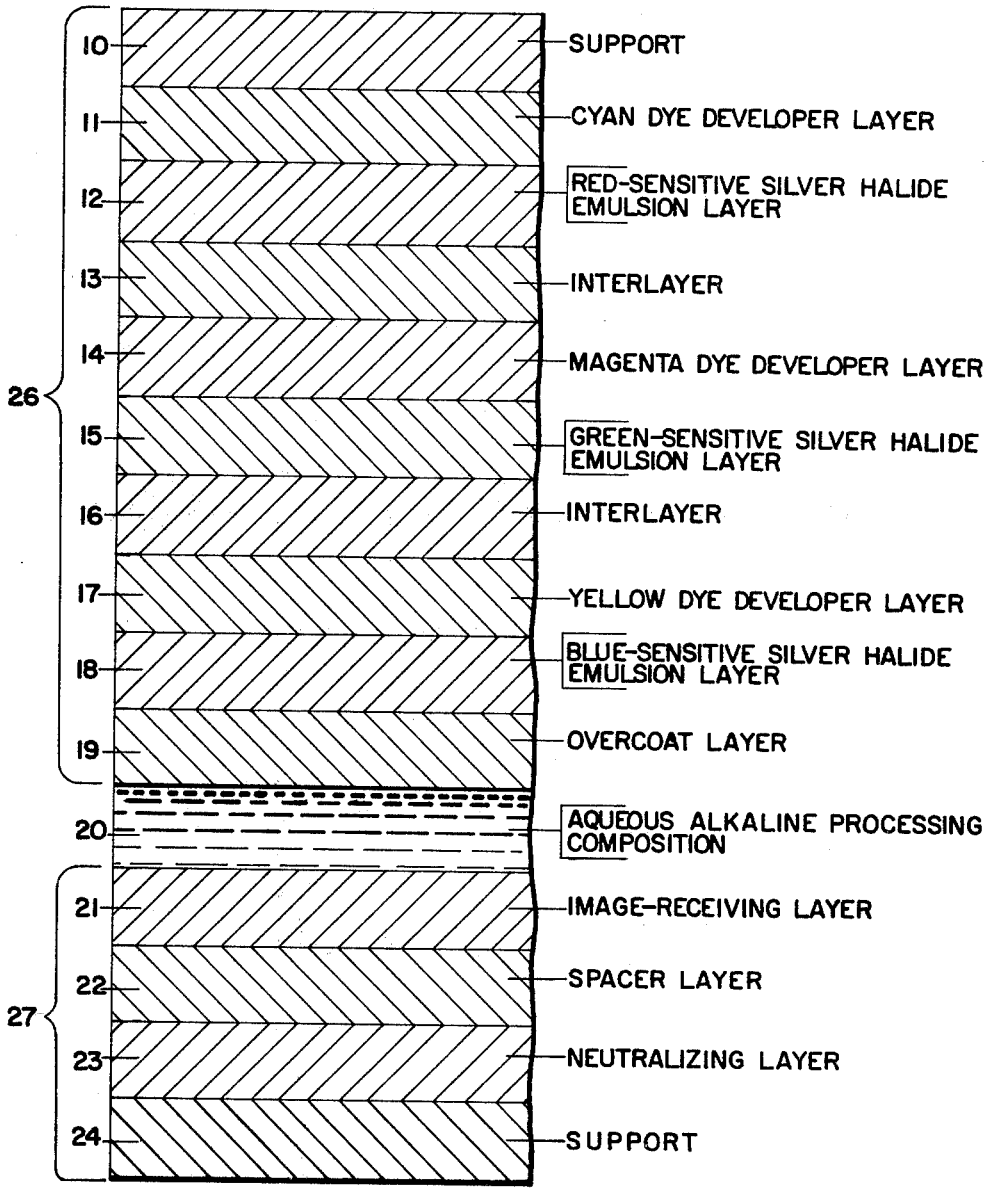
FIG. 1 is a cross-sectional view of a photographic film unit including diffusion control layers of this invention.

It is disclosed in copending U.S. Application Ser. No. 942,490, filed Sept. 15, 1978 in the name of Charles I. Sullivan, that diffusion control layers in diffusion transfer film units, which layers are capable of conversion from a condition of substantial impermeability to alkali or other reagent to a condition of substantial permeability to such materials following $\beta$-elimination, can be utilized to provide an impermeable barrier to the diffusion of such materials until $\beta$-elimination occurs. These polymers comprise monomeric units capable of undergoing a $\beta$-elimination reaction under the influence of alkali and having the structure:

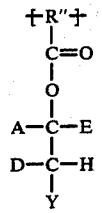

wherein R'' is the addition polymerization product of an ethylenically unsaturated alkyl group of from two to five carbon atoms, A, D and E are selected from the groups consisting of hydrogen, methyl and phenyl provided that no more than one of A, E or D may be methyl or phenyl and Y is an activating group. Typical activating groups disclosed therein comprise:

$-SO_2W$,

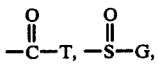

and —CN, where W is $-C_6H_5CH_3$, $-CH_3$, $-OC_2H_5$, $-C_6H_5$, $-NR_2$, $-N(CH_2C_6H_5)_2$; T is $-OC_2H_5$, $-CH_3$, —H, $-NH_2$, $-NR_2$; G is phenyl, methyl or ethyl and R is methyl or ethyl.

It is disclosed in the aforesaid patent application that diffusion control layers or those polymerization products are useful as interlayers and overcoats in photosensitive elements and as diffusion control overcoats and timing layers in image-receiving elements.

It has now been discovered that the use of graft copolymers comprising $\beta$-elimination monomeric units and hydrophobic comonomeric units grafted onto a polymeric backbone can be employed as diffusion control layers in photographic diffusion transfer units, and particularly, in such units adapted to the formation of diffusion transfer color images. It has been found that such graft copolymers are especially suited as diffusion control layers in image-receiving elements for desired rapid conversion from a condition of substantial impermeability to alkali to a condition of substantial permeability. Such graft copolymers are also useful as diffusion control layers in the form of interlayers or overcoats in photosensitive elements or overcoats in image-receiving elements.

In a preferred embodiment of the invention, the utilization of the graft copolymers of the invention as a timing layer provide to an image-receiving element the ability to accommodate minor fluctuations in the gap between the photosensitive element and the image-receiving element, the volume of such gap determines the amount of alkaline processing composition present when a film unit is being processed, the pH of which processing composition must be lowered to stop excessive transfer of dye image-forming material to the image-receiving element. In addition, the graft copolymer timing layer permits the alkalinity required for image-dye transfer to be maintained for a desired and longer duration.

As has been mentioned hereinbefore, the copolymers utilized as diffusion control layers in photographic diffusion transfer units are graft copolymers. In general, graft copolymers can be suitably prepared by grafting one or more monomeric units onto a polymeric backbone material capable of being oxidized in known manner with formation of reactive sites for the grafting of the monomeric compound(s) onto the polymeric backbone. Thus, an ethylenically unsaturated monomer, or a mixture of comonomeric compounds, can be suitably grafted onto a polymeric backbone material by oxidation in known manner with a transition metal ion catalyst. Any transition metal ion catalyst of a first oxidation state, having an oxidation potential in acidic solution of at least about one volt when the transition metal is reduced to the next lowest acidic solution stable oxidation state can be employed for this purpose. As preferred catalysts, mention may be made of transition metals from the group consisting of $V^{+5}$, $Ce^{+4}$ and $Cr^{+6}$.

With regard to the backbone polymer of the graft copolymer, in general, any organic polymer having repeating units containing the

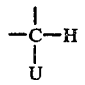

grouping, wherein U is selected from the group consisting of hydroxyl, amino, amido, mercapto, acyl and aroyl, are capable of being oxidized by a transition metal ion catalyst as stated above, and are, therefore, useful in the present invention, provided that the resulting graft copolymer can be coated onto a suitable substrate to provide a barrier layer capable of conversion from a relatively impermeable to a relatively permeable condition. The terms hydroxyl, acyl and aroyl as used above are intended to encompass partial acetals of these particular functional group terms. Suitable backbones include polyvinyl alcohol, gelatin, hydroxyethyl cellulose, polyvinyl pyrrolidone, polyacrylamide and the like. Preferred backbone materials include polyvinyl alcohol and substituted and unsubstituted cellulosic polymers such as hydroxyethyl cellulose. It is believed that upon oxidation of

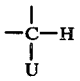

grouping of the backbone polymer, free radicals are formed which attack the double bonds of the comonomeric compounds, thus, initiating polymerization.

Grafted to the polymeric backbone is a hydrophobic monomer or mixture of monomers. Such monomers impart a degree of hydrophobicity to the graft copolymer coatable as a polymeric barrier material. The hydrophobicity imparted to the graft permits desired control of the permeability characteristics of the graft copolymer. As examples of hydrophobic monomers that can be utilized, mention may be made of N-methyl acrylamide; methacrylamide; ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl acrylamide; N-isopropyl acrylamide; N-(β-hydroxy ethyl) acrylamide, N-[β-dimethyl-amino)]acrylamide; N-t-butyl acrylamide; N-[β-(dimethylamino)ethyl]methacrylamide; 2-[2'-(acrylamido)ethoxy]ethanol; N-[3'-methoxy propyl]-acrylamide; 2-acrylamido-3-methyl butyramide; acrylamido acetamide; methacrylamido acetamide; 2-[2'-methacrylamido-3'-methyl butyramido]acetamide; and diacetone acrylamide or mixtures thereof.

The graft copolymers utilized herein as diffusion transfer control layers comprise essential monomeric units from a monomer capable of undergoing β-elimination in an alkaline environment and having the following formula

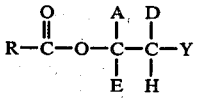

wherein R is an ethylenically unsaturated alkyl radical having from two to five carbon atoms, A, E and D are selected from the group consisting of hydrogen, methyl and phenyl, provided that no more than one of A, E or D may be methyl or phenyl and Y is an activating group. Typical monomers which have demonstrated that they provide to their polymerization product a β-eliminating activating group include 2-cyanoethyl acrylate, 2-cyanoethyl methacrylate, and 2-carbethoxyethyl methacrylate.

The graft copolymers of the invention can additionally contain units from other ethylenically unsaturated monomers to provide particular and desired properties. Thus, for example, compounds such as ethyl acrylate or 2-acrylamido-2-methylpropane sulfonic acid can be utilized to provide hydrophobic/hydrophilic balance for control of temperature latitude and permeability in diffusion transfer processing.

Graft copolymers which are useful in the instant invention include the following:

(1) Acrylamide/diacetone acrylamide/β-cyanoethyl acrylate graft on polyvinyl alcohol (PVA)

PVA/DAA/AA/CEA=22/180/12/12 (parts by weight)

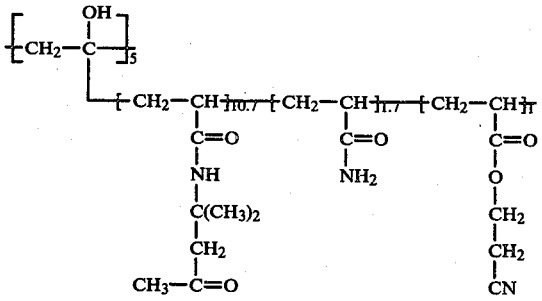

(2) Acrylamide/diacetone acrylamide/β-cyanoethyl acrylate graft on polyvinyl alcohol PVA/DAA/AA/CEA=22/180/6/24 (parts by weight)

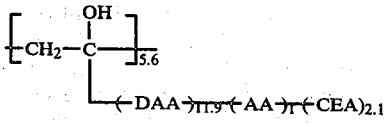

(3) Diacetone acrylamide/β-cyanoethyl acrylate graft on polyvinyl alcohol

PVA/DAA/CEA=22/180/36 (parts by weight)

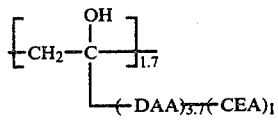

(4) Acrylamide/diacetone acrylamide/β-cyanoethyl acrylate graft on polyvinyl alcohol PVA/DAA/AA/CEA=22/180/12/24 (parts by weight)

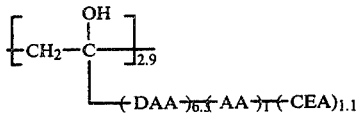

Other graft copolymers useful herein as diffusion control layers in photographic diffusion transfer units include the following:

(5) Diacetone acrylamide/β-cyanoethyl acrylate/2-acrylamido-2-methylpropane sulfonic acid/ethylacrylate graft on polyvinyl alcohol PVA/DAA/AMPS/EA=22/180/1/12 (parts by weight)

(6) Diacetone acrylamide/β-cyanoethyl acrylate/2-acrylamido-2-methylpropane sulfonic acid/acrylamide graft on polyvinyl alcohol PVA/DAA/CEA/AMPS/AA=22/180/24/1/12 (parts by weight)

(7) Diacetone acrylamide/β-cyanoethyl acrylate/2-acrylamido-2-methylpropane sulfonic acid/acrylamide graft on polyvinyl alcohol PVA/DAA/CEA/AMPS/AA=22/180/24/1/6 (parts by weight)

(8) Diacetone acrylamide/2-acrylamido-2-methylpropane sulfonic acid/β-cyanoethyl acrylate graft on polyvinyl alcohol PVA/DAA/AMPS/CEA=22/180/1/36 (parts by weight)

The β-eliminating monomer utilized in the preparation of the graft copolymers of the invention will be utilized in an amount sufficient to provide in the graft copolymer the capacity for appreciable conversion from a relatively impermeable condition to a condition of relative permeability and, thus, to provide functionality as a diffusion control layer as set forth hereinbefore. The amount of such β-eliminating monomer will vary depending upon the particular nature of the backbone polymer and comonomeric hydrophobic species, the proportions thereof and upon the particular and predetermined permeability characteristics of the diffusion control layer. In general, the β-eliminating monomer will be utilized in an amount such that the units from such monomer(s) comprise from about 2% to about 30% by weight of the graft copolymer, and preferably, from about 5 to about 25%. Similarly, the hydrophobic units from ethylenically unsaturated monomer(s) will comprise from about 50 to about 90% by weight of the graft copolymer.

Preferred graft copolymers herein are the grafts of β-eliminating monomer(s) and hydrophobic monomer(s) onto polyvinyl alcohol. In the case of such polyvinyl alcohol-based graft copolymers, a preferred β-eliminating monomer will be β-cyanoethyl acrylate, while preferred hydrophobic monomers comprise diacetone acrylamide, alkyl acrylates such as ethyl acrylate and butyl acrylate, and alkyl methacrylates such as methyl methacrylate. These preferred graft copolymers provide a desired barrier layer capable of conversion to a relatively permeable layer as described hereinbefore and are especially suited to coating onto a substrate for simultaneous drying along with other and multiple coatings of a diffusion transfer image-receiving element. These graft copolymers have also been found to provide considerable temperature latitude as timing layers in providing longer "hold" times at lower temperatures, e.g., 40° F., relative to the "hold" time observed at more elevated temperatures, e.g., 75° F.

The graft copolymers of the invention, capable of undergoing β-elimination in an alkaline environment, are useful for providing timed diffusion control in diffusion transfer photographic film units. Diffusion control layers of these graft copolymers may be formulated for use as diffusion control interlayers or overcoats in photosensitive elements, and as diffusion control, e.g., timing layers or overcoats, in image-receiving elements. These polymeric materials must undergo β-elimination before substantial swelling occurs, β-elimination and swelling being a prerequisite to permeation by alkali or by selected materials soluble in or solubilized by an aqueous alkaline processing fluid.

The β-elimination step which the polymeric materials of the diffusion control layers of this invention undergo ensures that there is a delay in permeability after contact of the diffusion control layer with an aqueous alkaline processing composition, and provides a "hold" of the alkali or soluble or solubilized material followed by a rapid "release" or opening to permit the alkali or soluble or solubilized material to pass. The polymeric materials may be thought of as "hold-release" polymers which delay diffusion therethrough of alkali or material soluble in or solubilized by processing fluid by a predetermined time, e.g., from less than five seconds to more several hundred seconds.

Figure 3:
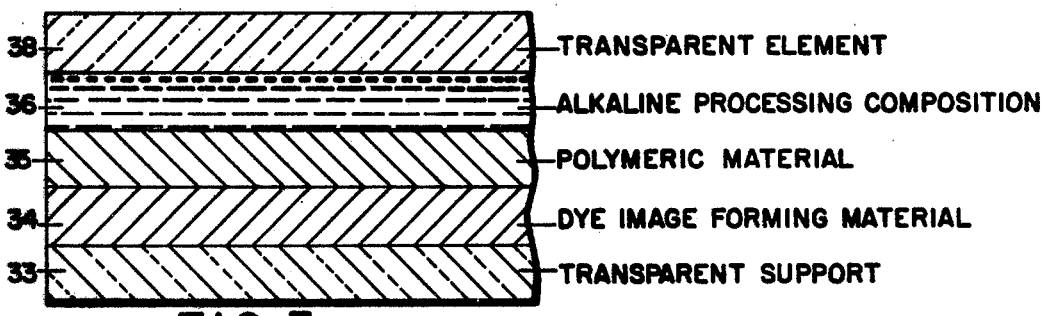
FIG. 3 illustrates a model arrangement for measuring the "hold-time" of interlayers of this invention.
Figure 4:
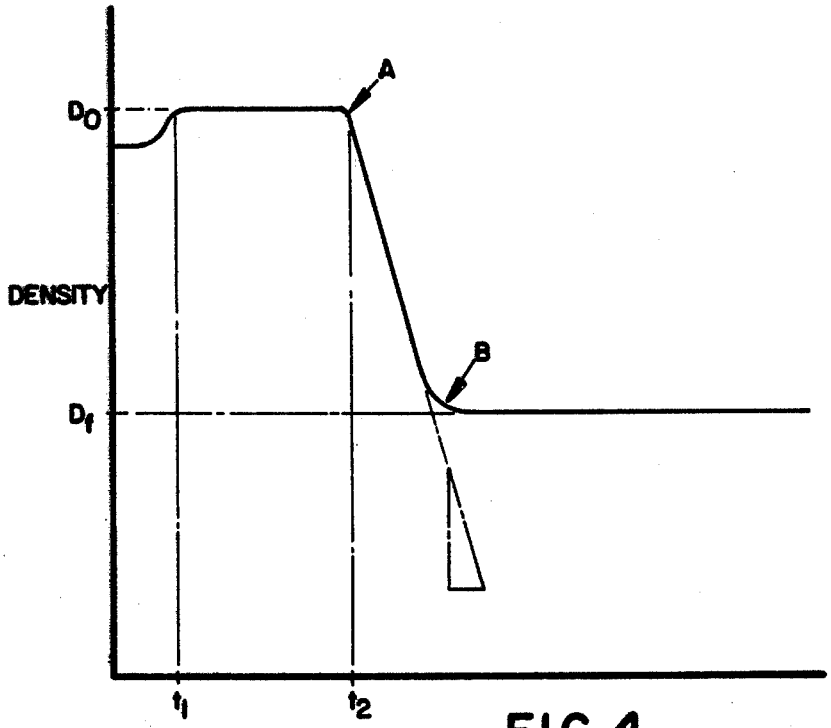

The mechanism by which the graft copolymers of the invention undergo a β-elimination reaction to provide desired "hold-release" function can be better understood by reference to the scheme of β-elimination in general. The introduction of double bonds into a molecule containing single bonds involves the elimination of atoms or groups from adjacent atoms. When elimination reactions involve β-substituted esters, acids, ketones, aldehydes and nitro compounds they are called β-eliminations. According to Hendrickson, Cram and Hammond, Organic Chemistry (3rd Edition, McGraw-Hill Book Company, 1970), the electron-withdrawing groups have strong acid-strengthening effects on the β-proton which is removed by base during the reaction. This 1,2-elimination under basic conditions is very familiar as shown by FIG. 14–3 from Hendrickson, Cram and Hammond which follows.

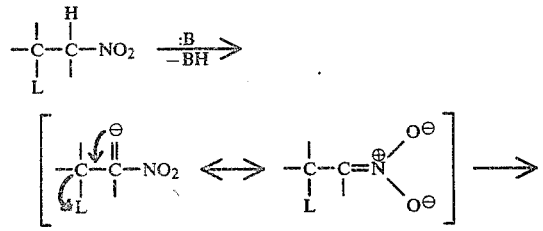

-continued

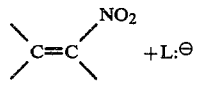

where L is a leaving group, B is a base and $—NO_2$ a typical activating group. In general terms this might be written:

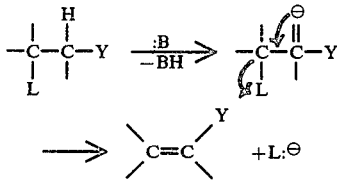

where Y is an activating group.

Substituents which activate β-elimination under basic conditions are known. The nature of the activation in β-eliminations was studied by J. Crosby and C. J. M. Stirling in J. Chem. Soc. (B) 1970 page 671. It was concluded that resonance stabilization of a carbanionic species was an important component of activation.

Such a β-substituted compound may be grafted onto a polymer as hereinbefore described to provide a polymer which is substantially impermeable to alkali or to certain materials which are soluble in or solubilized by alkaline processing fluid until after β-elimination breaks bonds liberating groups capable of absorbing water, swelling and causing the polymer to become permeable to such materials. Such polymer may be used as a diffusion control layer, the resulting predetermined time delay preventing premature diffusion of alkali or of soluble or solubilized materials. By controlling the mole proportion or ratio of such β-elimination moieties grafted onto the polymer, as well as the thickness of the polymeric layer, one may provide a predetermined permeability time desired for the particular diffusion transfer system.

With reference to the above general formulation for β-elimination, the β-elimination scheme for a graft copolymer of polyvinyl alcohol, β-eliminating monomer and hydrophobic monomer diacetone acrylamide (DAA) may be represented as follows:

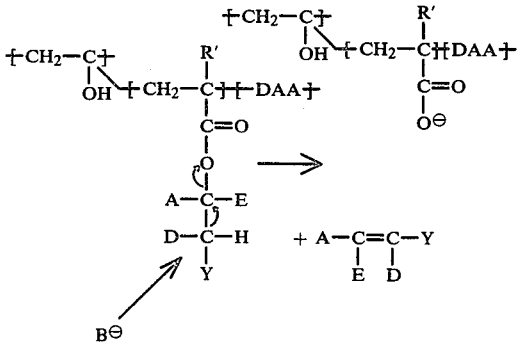

-continued where L is

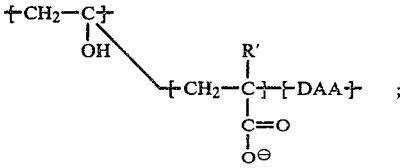

R′ is e.g., hydrogen or methyl; Y is selected from the group consisting of $—SO_2W$,

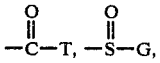

and —CN; where W is $—C_6H_5CH_3$, $—CH_3$, $—OC_2H_5$, $—C_6H_5$, $—NR_2$, $—N(CH_2C_6H_5)_2$; T is $—OC_2H_5$, $—CH_3$, —H, $—NH_2$, $—NR_2$; G is phenyl, methyl or ethyl and R is alkyl; and B, A, E and D are as defined hereinbefore.

The graft copolymers hereof can be utilized in a number of diffusion transfer photographic processes based upon imagewise transfer of diffusible image-forming material, e.g., dye, dye intermediate or soluble silver complex. A system useful herein and especially suited to the formation of color images by diffusion transfer is that described in U.S. Pat. No. 2,983,606, utilizing a dye developer as the image-forming material. In such systems, a photosensitive element comprising at least one silver halide layer having a dye developer associated therewith is developed by applying an aqueous alkaline processing composition. Exposed and developable silver halide is developed by the dye developer which in turn becomes oxidized to provide an oxidation product which is appreciably less diffusible than the unreacted dye developer, thereby providing an imagewise distribution of diffusible dye developer in terms of unexposed areas of the silver halide layer, which imagewise distribution is then transferred, at least in part, by diffusion, to a dyeable stratum to impart thereto a positive dye transfer image. Multicolor images may be obtained with a photosensitive element having two or more selectively sensitized silver halide layers and associated dye developers, a tripack structure of the type described above in various patents including the aforementioned U.S. Pat. Nos. 2,983,606 and 3,345,163 being especially suitable.

In such color diffusion transfer systems, color transfer images are obtained by exposing a photosensitive element, sometimes referred to as a "negative component", comprising at least a light-sensitive layer, e.g., a gelatino silver halide emulsion layer, having an image dye-providing material associated therewith in the same or in adjacent layer, to form a developable image; developing this exposed element with a processing composition to form an imagewise distribution of a diffusible image dye-providing material; and transferring this imagewise distribution, at least in part by diffusion, to a superposed image-receiving layer, sometimes referred to as a "positive component", comprising at least a dyeable stratum to provide a color transfer image. The negative and positive components initially may be carried on separate supports which are brought together during processing and thereafter separated or retained together as the final integral negative-positive reflection print, or they may initially comprise a unitary structure, e.g., integral negative-positive film units wherein the negative and positive components are part of a photosensitive laminate or they may otherwise be physically retained together in superposed relationship prior to, during and after image formation. Film units intended to provide multicolor images comprise two or more selectively sensitized silver halide layers each having associated therewith an appropriate image dye-providing material providing an image dye with spectral absorption characteristics substantially complementary to the light by which the associated silver halide is exposed. The most commonly employed negative components for forming multicolor images are of the tripack structure and contain blue, green and red sensitive silver halide layers each having associated therewith in the same or in a contiguous layer a gellow, a magenta and cyan image dye-providing material respectively. Interlayers or spacer layers of graft copolymer as described herein can be provided between the respective silver halide layers and associated image dye-providing materials or between other layers.

The image-receiving layer may comprise one of the materials known in the art, such as polyvinyl alcohol, gelatin, etc. It may contain agents adapted to mordant or otherwise fix the transferred image dye(s). If the color of the transferred image dye(s) is affected by changes in pH, the pH of the image layer may be adjusted to provide a pH affording the desired color.

In the various color diffusion transfer systems which have previously been described and which employ an aqueous alkaline processing fluid, it is well known to employ an acidreacting reagent in a layer of the film unit to lower the environmental pH following substantial dye transfer in order to increase the image stability and/or to adjust the pH from the first pH at which the image dyes are diffusible to a second (lower) pH at which they are not. For example, the previously mentioned U.S. Pat. No. 3,415,644 discloses systems wherein the desired pH reduction may be effected by providing a polymeric acid layer adjacent the dyeable stratum. These polymeric acids may be polymers which contain acid groups, e.g., carboxylic acid and sulfonic acid groups, which are capable of forming salts with alkali metals or with organic bases; or potentially acid-yielding groups such as anhydrides or lactones. Preferably the acid polymer contains free carboxyl groups. Alternately, the acid-reacting reagent may be in a layer adjacent the silver halide most distant from the image-receiving layer.

An inert interlayer or spacer layer may be and is preferably disposed between the polymeric acid layer and the dyeable stratum in order to control or "time" the pH reduction so that it is not premature and interfere with the development process.

While the acid layer and associated spacer layer are preferably contained in the positive component employed in systems wherein the dyeable stratum and photosensitive strata are contained on separate supports, e.g., between the support for the receiving element and the dyeable stratum; or associated with the dyeable stratum in those integral film units, e.g., on the side of the dyeable stratum opposed from the negative components, they may, if desired, be associated with the photosensitive strata, as is disclosed, for example, in U.S. Pat. Nos. 3,362,821 and 3,573,043. In film units such as those described in the aforementioned U.S. Pat. Nos. 3,594,164 and 3,594,165, they also may be contained on the spreader sheet employed to facilitate application of the processing fluid.

As is now well known, the liquid processing composition referred to for effecting diffusion transfer processes comprises at least an aqueous solution of an alkaline material, for example, sodium hydroxide, potassium hydroxide, and the like, and preferably possessing a pH in excess of 12, and most preferably include a viscosity-increasing compound constituting a film-forming material of the type which, when the composition is spread and dried, forms a relatively firm and relatively stable film. The film-forming material is preferably contained in the processing composition in such suitable quantities as to impart to the composition a viscosity in excess of 100 cps. at a temperature of approximately 24° C. and preferably in the order of 1,000 cps. to 200,000 cps. at that temperature.

U.S. Pat. No. 3,362,819, issued Jan. 1, 1968, discloses image-receiving elements particularly adapted for employment in diffusion transfer processes which elements comprise a support layer possessing on one surface thereof, in sequence, a polymeric acid layer; and inert timing or spacer layer; and an image-receiving layer adapted to provide a visible image upon transfer to said layer of diffusible dye image-forming substances.

As set forth in the last-mentioned patent, and useful herein, the polymeric acid layer comprises polymers which contain acid groups, such as carboxylic acid and sulfonic acid groups, which are capable of forming salts with alkali metals, such as sodium, potassium, etc., or with organic bases, particularly quaternary ammonium bases, such as tetramethyl ammonium hydroxide, or potentially acid-yielding groups, such as anhydrides or lactones, or other groups which are capable of reacting with bases to capture and retain them. The acidreacting group is, of course, nodiffusible from the acid polymer layer. In the preferred embodiments disclosed, the acid polymer contains free carboxyl groups and the transfer processing composition employed contains a large concentration of sodium and/or potassium ions. The acid polymers stated to be most useful are characterized by containing free carboxy groups, being insoluble in water and the free acid form, and by forming water-soluble sodium and/or potassium salts. One may also employ polymers containing carboxylic acid anhydride groups, at least some of which preferably have been converted to free carboxyl groups prior to imbibition. While the most readily available polymeric acids are derivatives of cellulose or of vinyl polymers, polymeric acids from other classes of polymers may be used.

The acid polymer layer is disclosed to contain at least sufficient acid groups to effect a reduction in the pH of the image layer from a pH of about 12 to 14 to a pH at least 11 and preferably to a pH of about 5 to 8 after a predetermined period.

It is, of course, necessary that the action of the polymeric acid be so controlled as not to interfere with either development of the negative or image transfer of unoxidized dye developers. For this reason, the pH of the image layer is kept at a level of pH 12 to 14 until the positive dye image has been formed after which the pH is reduced very rapidly to the desired final pH.

In order to prevent premature pH reduction during transfer processing, as evidenced, for example, by an undesired reduction in positive image density, the acid groups are disclosed to be so distributed in the acid polymer layer that the rate of their availability to the alkali is controllable, e.g., as a function of the rate of swelling of the polymer layer which rate in turn has a direct relationship to the diffusion rate of the alkali ions.

The desired distribution of the acid groups in the acid polymer layer may be effected by mixing the acid polymer with a polymer free of acid groups, or lower in concentration of acid groups, and compatible therewith, or by using only the acid polymer but selecting one having a relatively lower proportion of acid groups.

It is also disclosed that the layer containing the polymeric acid may contain a water insoluble polymer, such as, for example, a cellulose ester, which acts to control or modulate the rate at which the alkali salt of the polymer acid is formed. As examples of cellulose esters contemplated for use, mention is made of cellulose acetate, cellulose acetate butyrate and the like. The particular polymers and combinations of polymers employed in any given embodiment are, of course, selected so as to have adequate wet and dry strength and when necessary or desirable, suitable subcoats may be employed to help the various polymeric layers adhere to each other during storage and use.

The inert spacer layer, a layer comprising polyvinyl alcohol or gelatin, for example, in the aforementioned patent, acts to "time" control the pH reduction by the polymeric acid layer. This timing is a function of the rate at which the alkali diffuses through the inert spacer layer.

If the alkali barrier (the spacer layer) is one that does not hold the alkali back for a time and then switch to allowing the alkali through, but, rather, is one that allows the alkali to trickle through, then, as processing times are shortened, differences in maximum densities obtained as a function of the processing time become more pronounced.

The utilization of the graft copolymers herein as diffusion control layers in photographic diffusion transfer units may be better understood by reference to the drawings. As shown in FIG. 1, the diffusion control layers of this invention may be employed in a photographic film unit having a photosensitive element 26 and an image-receiving element 27. Interlayers 13 and 16 are positioned between red- and green-, and blue- and green- sensitive silver halide emulsions, respectively, in the photosensitive element. These interlayers and the emulsions with their associated dye image-forming material, e.g., dye developer, are preferably arranged on a support 10 in the following order from that support: cyan dye developer layer 11, red-sensitive silver halide emulsion layer 12, interlayer 13, magenta dye developer layer 14, green-sensitive silver halide emulsion 15, interlayer 16, yellow dye developer layer 17 and blue-sensitive silver halide emulsion layer 18. An overcoat layer 19 of graft copolymer described herein or of other polymer may be coated on top of the blue-sensitive silver halide emulsion layer.

The image-receiving element illustrated in FIG. 1 comprises in order, an image-receiving layer 21, a spacer or timing layer 22, a neutralizing layer 23 and a support layer 24. During processing the image-receiving layer is situated closest to the photosensitive element.

After the photosensitive element has been exposed, aqueous alkaline processing composition 20 is introduced between the photosensitive and image-receiving elements and permeates the emulsion layers to initiate development of the latent image carried therein and provide a medium for dye diffusion transfer to the image-receiving element. Dye image-formingg materials associated with unexposed portions of the emulsion layers diffuse to the image-receiving element in known manner. As set forth in U.S. Pat. No. 3,362,819, situated beneath the image-receiving layer is a neutralizing layer containing a polymeric acid to neutralize alkali in the processing composition after a predetermined period.

The timing or spacing layer, comprised of polymeric material and located between the image-receiving and neutralizing layers is used to control the pH reduction. Diffusion control layers comprising a $\beta$-elimination graft copolymer in accordance with this invention comprise, in one preferred embodiment, interlayers 13 and/or 16. In another preferred embodiment the spacer layer 22 comprises a diffusion control graft copolymer layer of the invention.

Figure 2:
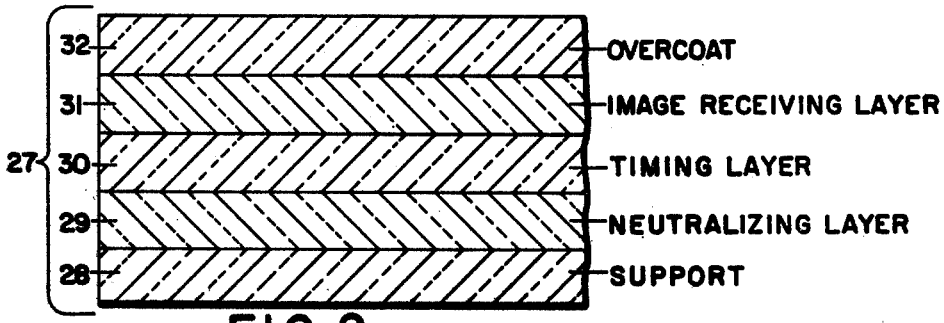
FIG. 2 is a cross-sectional view of an image-receiving element including a diffusion control timing layer of this invention.

The image-receiving element 27 illustrated in FIG. 2 comprises in order, a support layer 28, a neutralizing layer 29, a spacer or timing layer 30, an image-receiving layer 31 and an overcoat 32. During processing the image-receiving element overcoat is situated closest to the photosensitive element. In one embodiment of this invention, a diffusion control layer comprising a $\beta$-elimination graft copolymer material in accordance with this invention comprises overcoat layer 32.

With multicolor diffusion transfer products such as those described above employing two or more sets of silver halide emulsion layers, each layer having its own dye image-forming material associated therewith, premature migration of the color-providing material during processing can produce undesirable inter-image effects wherein the dye or other color providing material is controlled at least in part by the "wrong" silver halide layer, i.e., a silver halide layer other than the one with which it was initially associated in the film unit.

This problem may be further illustrated by reference to a conventional tripack negative employing dye developers, wherein the negative is comprised of a support carrying a red-sensitive silver halide layer having a cyan dye developer associated therewith, a green-sensitive silver halide layer having a magenta dye developer associated therewith and a blue-sensitive silver halide layer having a yellow dye developer associated therewith. Ideally, solubilized dye developer should diffuse to its associated silver halide layer, and if not bound in that layer it diffuses further to the image receiving element. Diffusion through the silver halide layer is generally controlled by development of the silver halide layer. If the dye developer is permitted to migrate to other silver halide layers before its associated silver halide layer has been developed, the resultant transfer image will have something less than the desired color fidelity due to dye loss and/or transfer of the wrong dye.

To illustrate further, if it is possible for the magenta dye developer to back-diffuse to the red sensitive silver halide layer before development of this layer by the cyan dye developer, some of the magenta dye developer may develop silver halide in this "wrong" layer and be tied up or rendered nondiffusible. This will produce a loss of magenta dye, or so called "magenta drop off", in the transfer image. Moreover, development of the red-sensitive silver halide layer by magenta dye developer permits some of the cyan dye developer which should have instead been oxidized to diffuse to the image-receiving element, thereby resulting in unwanted cyan transfer.

To obviate or minimize these inter-image effects, interlayers of graft copolymer as described hereinbefore can be employed in a photosensitive element between the emulsions and their individual associated dye image-forming materials. The β-elimination step which the graft copolymers of the diffusion control layers of this invention undergo ensures that there is a delay in permeability after contact of the diffusion control layer with the processing composition, and provides a "hold" of the soluble or solubilized material followed by a rapid "release" or opening to permit the soluble or solubilized material to pass. The polymeric materials may, thus, be thought of as "hold-release" polymers which delay diffusion therethrough of material soluble in or solubilized by processing fluid by a predetermined time.

The time for β-elimination to occur subsequent to contact with processing composition and for subsequent hydration should be sufficient to maintain the interlayer substantially impermeable to solubilized dye image-forming material until there has been at least substantial development of the emulsions between the interlayer and the image-receiving layer but before there has been substantial fogging of the emulsion layer with the most rapid fogging rate.

The diffusion control layers of this invention may be used as interlayers between silver halide emulsion layer sensitized to different regions of the spectrum, each emulsion having an associated dye image-forming material. They may be utilized, e.g., in the manner described in aforementioned U.S. Pat. Nos. 3,615,422 and 3,421,892, substituting the hold-release graft copolymers of this invention for the interlayer polymer compositions disclosed therein.

The capacity of a graft copolymer diffusion control layer of the invention to delay permeation therethrough of image-forming dye until conversion by a β-elimination reaction to a relatively dye-permeable polymer can be conveniently evaluated by resort to the utilization of a test structure shown in FIG. 3. Onto a transparent support 33 in FIG. 3, a layer 34 comprising a cyan dye developer, gelatin and a hardener such as succinaldehyde can be coated using a conventional loop coater. Over this layer, a layer of the candidate graft copolymer is coated. A transparent element 38 of polyester film base is superposed with the test element and an opaque alkaline processing composition including titanium dioxide is introduced therebetween as shown in FIG. 3. The optical reflection density to red light of the test structure, viewed through support 33, can then be read continuously using, for example, a MacBeth Quanta-Log densitometer equipped with a Hewlett-Packard 17505A strip-chart recorder. This density comprises contributions from the dye image-forming material remaining in the dye layer and dye image-forming material in the test layer. The titanium dioxide in the processing composition masks dye image-forming material in the processing composition layer. By thus monitoring dye transfer through the polymeric test material, the "hold-release" properties of the test material can be evaluated in simulation of the functioning of the material as, e.g., an interlayer in a photosensitive element.

As indicated hereinbefore, the utilization of a graft copolymer diffusion control layer as a timing or spacing layer in an image-receiving element constitute a preferred embodiment of the invention. Such layer, employed between the alkaline processing composition introduced into the diffusion transfer film unit and a neutralizing layer, e.g., a polymeric acid layer, can effectively control the initiation of pH reduction by acting as a substantially impermeable barrier to the alkaline processing composition until β-elimination occurs. The permeation characteristics of the graft copolymers utilized herein as timing layers can be conveniently evaluated by measuring "clearing time" in accordance with the following method.

An image-receiving element comprising in order on a support, a polymeric acid layer, a test timing layer and a mordanting layer, is spread with an alkaline processing material of high pH comprising an indicator dye which is highly colored at pH's of about 12 to 14 and colorless below about 10. A transparent cover sheet is superposed the processing material. The view through the cover sheet toward the image-receiving element is dark until the alkali has penetrated to the polymeric acid layer where the pH is reduced by alkali consumption and the indicator dye becomes colorless, the system has "cleared". A skilled operator can determine when the clearing begins and when it is complete. A "leaky" timing layer allows a trickle of alkali through from the moment of first contact and shows no precipitous change in beginning to clear nor in the final clearing. A timing layer comprising the graft copolymers of the instant invention will hold the alkali back for a predetermined period, and then, over a short time interval, allow sufficient alkali through to drop the pH below the transition range of the indicator dye.

Clearing time can be measured for a structure that comprises an entire image-receiving element or it can be measured for a model simplified structure that includes only the timing layer coated over the polymeric acid layer on the support. The first clearing time is referred to as "clearing through the mordant" while the second model structure clearing is referred to as "clearing through the timing layer".

This invention will be further illustrated by the following examples intended to be illustrative only.

EXAMPLES 1–4

Four test elements were prepared by coating a transparent 4 mil polyethylene terephthalate film base with a polymeric acid layer comprising 80 parts by weight of a polyvinylmethylether, maleic anhydride copolymer mixed with 20 parts by weight of polyvinyl alcohol at a thickness of 1 mil, followed by the below detailed timing layers:

#1. A graft copolymer of diacetone acrylamide (180 parts by weight), 2-cyanoethyl acrylate (12 parts), 2-acrylamido-2-methylpropane sulfonic acid (1 part), and ethyl acrylate (12 parts) on 22 parts by weight of polyvinyl alcohol.

#2. A graft copolymer of diacetone acrylamide (180 parts by weight), 2-cyanoethyl acrylate (24 parts), 2-acrylamido-2-methyl propane sulfonic acid (1 part) and acrylamide (12 parts) on 22 parts by weight of polyvinyl alcohol.

#3. A graft copolymer of diacetone acrylamide (180 parts by weight), 2-cyanoethyl acrylate (24 parts), 2-acrylamido-2-methyl propane sulfonic acid (1 part) and acrylamide (6 parts) on 22 parts by weight of polyvinyl alcohol.

#4. A graft copolymer of diacetone acrylamide (180 parts by weight), 2-acrylamido-2-methyl propane sulfonic acid (1part) and 2-cyanoethyl acrylate (36 parts) on 22 parts by weight of polyvinyl alcohol.

A standard element was prepared by coating over the polymeric acid layer on the film base, a timing layer comprising 100 parts by weight of 60/4/30/6 polymer of butyl acrylate/styrene/diacetone acrylamide/methacrylic acid mixed with 7 parts by weight of polyvinylalcohol.

The polymer of timing layer #1 was prepared as follows:

To a solution of 22 g (0.5 moles) of polyvinyl alcohol in 1 l distilled water was added 180 g (1.07 moles) of diacetone acrylamide, 12 g, (0.10 moles) of 2-cyanoethylacrylate and 1 g (0.005 moles) of 2-acrylamido-2-methyl propane sulfonic acid. After the monomers were dissolved, the pH of the solution was adjusted to 1.5 with concentrated nitric acid. The solution was deaerated with nitrogen for an hour. After the dearation was completed 4.4 g. of the surfactant, Triton X-100, was added. The reaction mixture was stirred until the surfactant dissolved completely. 12 g (0.12 moles) of previously deaerated ethyl acrylate was added dropwise over several minutes. 4 g of ceric ammonium nitrate in 20 cc of water was added and the polymerization allowed to continue for two hours at room temperature. The conversion of monomer to polymer was in excess of 98.5%.

The polymer of timing layer #2 was prepared as follows:

To a solution of 22 g (0.5 moles) of polyvinyl alcohol in 1 l of distilled water was added 180 g (1.07 moles) of diacetone acrylamide, 12 g (0.17 moles) of acrylamide, 24 g (0.19 moles) of 2-cyanoethyl acrylate and 1 g (0.005 moles) of 2-acrylamido, 2-methyl propane sulfonic acid. After the monomers were dissolved the pH of the solution was adjusted to 1.5 with concentrated nitric acid. The stirred solution was deaerated with nitrogen for an hour. After deaeration was complete 4.4 g of the surfactant Triton X-100 was added. Stirring was continued until the surfactant dissolved completely. With nitrogen passing over the solution, 4 g of ceric ammonium nitrate dissolved in 20 cc of water was added to the stirred reaction solution. Stirring was continued for two hours. Conversion of monomer to polymer was in excess of 98.5%.

The polymer of timing layers #3 and #4 were prepared in the same manner as was the polymer of #2 with only the amounts of acrylamide and 2-cyanoethyl acrylate varied.

A transparent element comprising a polyester clear film base was superposed with the test elements and the standard element to form sandwiches and an alkaline processing composition comprising

| | |
|---|---|
| 100cc | water |
| 4.0g | hydroxyethyl carboxymethyl cellulose |
| 20.8g | 50% solution of potassium hydroxide |
| 1.1g | benzotriazole |
| 0.5g | thymol phthalein |

was introduced between the test material layer and the transparent element at varying below indicated gaps. The time, denoted as permeation time and measured in seconds, for the sandwich to change color from blue to colorless is a measure of the time necessary for the processing composition to permeate the timing layer and react with the polymeric acid layer, lowering the pH. Times are recorded as "start", when the sandwich first starts to clear and "finish" when the sandwich has substantially completed clearing.

| Gap (inches) | Clearing times (start-finish) sec | | | | |
|---|---|---|---|---|---|
| | Standard | Example #1 | Example #2 | Example #3 | Example #4 |
| 0.0036 | 180–265 | 585–665 | 61–69 | 120–137 | 83–114 |
| 0.0028 | 144–224 | 585–684 | 60–65 | 120–140 | 80–110 |
| 0.0022 | 103–203 | 610–697 | N.M | N.M | N.M |
| 0.0016 | | N.M | 60–66 | 122–139 | 80–106 |

The preceding data illustrates relative insensitivity of the permeation characteristics of the disclosed graft copolymers to gap variation (amount of processing composition spread). Moreover, there is illustrated the relative "leaky" character of the "Standard" timing layer compared with the "hold-release" properties of the graft copolymer timing layers hereof.

EXAMPLE 5

The following illustrates the constancy of the "hold-release" graft copolymer timing layers of the instant invention, as a function of the concentration of alkali present, as compared to the relative dependence of a conventional timing layer upon varying alkali levels.

Test elements were prepared by coating a transparent 4 mil polyethylene terephthalate film base with the following layers:

1. a polymeric acid layer comprising 80 parts by weight of a polyvinylmethyl ether, maleic anhydride copolymer mixed with 20 parts by weight of polyvinyl alcohol at a thickness of 1 mil; and 2. a timing layer comprising a graft copolymer of 180 parts by weight of diacetone acrylamide, and 36 parts by weight of 2-cyanoethylacrylate on 22 parts by weight of polyvinyl alcohol and coated at a coverage of about 500 mgs/ft$^2$.

Conventional elements for comparison were prepared by coating a transparent 4 mil polyethylene terephthalate film base with the following layers:

1. a polymer acid layer, comprising 80 parts by weight of a polyvinylmethyl ether, maleic anhydride copolymer mixed with 20 parts by weight of polyvinyl alcohol at a thickness of 1 mil; and 2. a timing layer comprising a 60/30/4/6 interpolymer of butyl acrylate, diacetone acrylamide, styrene and methacrylic acid thickened with 7% by weight of polyvinyl alcohol coated at a coverage of about 500 mg/ft$^2$.

A transparent element comprising a polyester clear film base was superposed with the test elements to form sandwiches and an alkaline processing composition was introduced between the polymeric test material layer and the transparent element at a gap of 0.0028 in. The permeation time was measured as in examples 1–5.

For the 5A experiment, the following alkaline processing composition was used:

| | |
|---|---|
| 100cc | water |
| 4.0g | hydroxyethyl carboxymethyl cellulose |
| 4.2g | 50% solution of potassium hydroxide |
| 1.1g | benzotriazole |
| 0.5g | thymolphthalein |

For the 5B experiment, the following alkaline processing composition was used:

| | |
|---|---|
| 100cc | water |
| 4.0g | hydroxyethyl carboxymethyl cellulose |
| 20.8g | 50% solution of potassium hydroxide |
| 1.1g | benzotriazole |
| 0.5g | thymol phthalein |

| Experiment | Clearing Time Start (sec.) | Clearing Time Finish (sec.) |
|---|---|---|
| 5A Test | 77 | 104 |
| 5A Conventional | 6 | 9 |
| 5B Test | 80 | 110 |
| 5B Conventional | 144 | 224 |

It is seen that while the clearing time for the conventional element depends strongly upon the concentration of alkali present, the clearing time for the test elements comprising the graft copolymers of the instant invention are remarkably constant over the four-fold increase in the amount of alkali present.

EXAMPLES 6-7

Image-receiving elements, E6, E7 and a standard, each having on a transparent 4 mil polyethylene terephthalate film base a polymeric acid layer, a timing layer and an image-receiving layer as detailed below were prepared.

| | E6 | E7 | Standard |
|---|---|---|---|
| Polymer Acid Layer | Ia | Ia | Ib |
| Timing Layer | IIa | IIa | IIb |
| Image-receiving Layer | IIIa | IIIb | IIIa |

wherein I*a* is a mixture of 80 parts by weight of a polyvinylmethyl ether, maleic anhydride copolymer mixed with 20 parts by weight of polyvinyl alcohol at a thickness of 1 mil; II*a* is a graft copolymer of diacetone acrylamide (180 parts by weight), acrylamide (6 parts), 2-cyanoethyl acrylate (24 parts) and 2-acrylamido, 2-methyl propane sulfonic acid (2 parts) on 22 parts by weight of polyvinyl alcohol coated at a coverage of about 500 mg/ft$^2$; III*a* is a blend of 2 parts by weight of polyvinyl alcohol, 1 part by weight of poly-4-vinyl pyridine and 1 part by weight of a graft of 4-vinyl pyridine and vinylbenzyltrimethyl ammonium chloride on hydroxyethyl cellulose, (The ratios of the graft polymer being hydroxyethyl cellulose, 2.2: 4-vinyl pyridine, 2.2: vinylbenzyltrimethyl ammonium chloride, 1) coated at a coverage of about 300 mg/ft$^2$; I*b* is the polyvinylene/-maleic anhydride copolymer mixed with about 20% by weight of polyvinyl alcohol and coated at a coverage of about 1600 mg/ft$^2$; II*b* a 4:1 ratio of a 60-30-4-6 tetrapolymer of butyl acrylate, diacetone acrylamide, styrene and methacrylic acid and polyvinyl alcohol coated at a coverage of about 500 mg/ft$^2$; and III*b* is a graft of 4-vinyl pyridine (2.2 parts by weight) and vinyl benzyl trimethyl ammonium chloride (1 part by weight) on hydroxyethyl cellulose (2.2 parts by weight), coated at a coverage of about 300 mg/ft$^2$.

In the conduct of the evaluation set forth in the following table, the Processing Compositions, identified as A and B were as follows:

Processing Composition A comprised:

| | |
|---|---|
| 100cc | water |
| 4.0g | hydroxyethyl carboxymethyl cellulose |
| 20.8g | 50% solution of potassium hydroxide |
| 1.1g | benzotriazole |
| 0.5g | thymol phthalein |

Processing Composition B comprised:

| | |
|---|---|
| 100cc | water |
| 4.8g | hydroxyethylcarboxymethyl cellulose |
| 25.7g | potassium hydroxide, 45% solution |
| 1.8g | benzotriazole |
| 0.5g | 4-aminopyrazolo-3,4,D pyrimidine |
| 0.5g | 5-methyl uracil |

0.7g

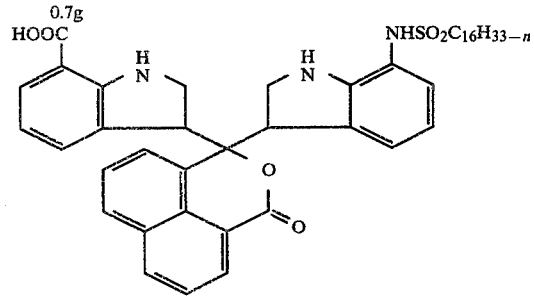

3.2g

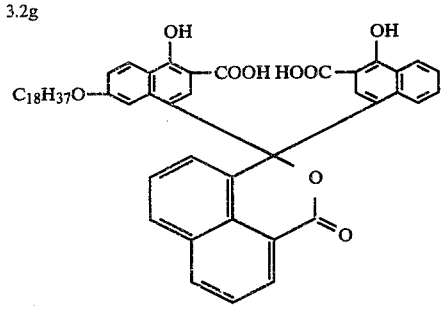

| | |
|---|---|
| 1.9g | ethylene diamine tetracetic acid |
| 0.05g | bis-(β-aminoethyl) sulfide |
| 1.2g | high molecular weight polyethylene glycol |
| 88.8g | titanium dioxide |
| 3.9g | colloidial silica |
| 5.7g | N-phenethyl-α-picolinium bromide |

Clearing times were measured as in Examples 1-4. The time are listed in the table below:

| Element | Processing Composition | Gap (inch) | Time (sec) start-finish |
|---|---|---|---|
| E6 | A | 0.0028 | 176-184 |
| E6 | A | 0.0022 | 225-265 |
| E7 | A | 0.0028 | 222-267 |
| E7 | A | 0.0022 | 304-357 |
| Std | A | 0.0028 | 180-222 |
| Std | A | 0.0022 | 138-173 |
| E7 | B | 0.0030 | 223-272 |
| Std | B | 0.0030 | 199-424 |

The preceding data illustrates relative insensitivity of image-receiving elements of the invention containing the graft copolymers hereof to gap variation and illustrates the hold-release properties of such graft copolymers in relative contrast to the "leaky" characteristic of timing layer of the "Standard" image-receiving element.

EXAMPLES 8 and 9

Two additional test elements were prepared by coating a transparent 4 mil polyethylene terephthalate film base with a polymeric acid layer comprising 89 parts by weight of the half butyl ester of ethylene/maleic anhydride copolymer mixed with 11 parts by weight of polyvinyl butyral at a thickness of 2 mil, followed by the below detailed timing layers:

Example #8—A graft copolymer of butyl acrylate (180 parts by weight), 2-cyanoethyl acrylate (40 parts), 2-acrylamido-2-methylpropane sulfonic acid (1 part by weight) on 22 parts by weight of polyvinyl alcohol.

Example #9—A graft copolymer of butyl acrylate (90 parts by weight), methyl methacrylate (40 parts by weight), 2-cyanoethyl acrylate (20 parts by weight) on 22 parts by weight polyvinyl alcohol.

A second standard element (Std #2) was prepared by coating over the half butyl ester of polymeric acid, polyvinyl butyral mixture on the film base, a timing layer comprising 100 parts by weight of a 60/4/30/6 polymer of butyl acrylate/styrene/diacetone acrylamide/methacrylic acid mixed with 7 parts by weight of polyvinyl alcohol.

The polymer of timing layer Example #8 was prepared as follows:

To a solution of 22 g. (0.5 moles) of polyvinyl alcohol in 1 liter distilled water was added 180 g. (1.4 moles) of butyl acrylate, 40 g. (0.32 moles) of 2-cyanoethyl-acrylate and 1 g. (0.005 moles) of 2-acrylamido-2-methyl propane sulfonic acid. The pH of the mixture was adjusted to 1.5 with concentrated nitric acid. The mixture was deaerated with nitrogen for an hour. After the deaeration was completed 26 g. of the surfactant, Abex 265, was added. The reaction mixture was stirred until the surfactant dissolved completely. 4 g. of ceric ammonium nitrate in 20 cc of water was added and the polymerization allowed to continue for two hours at room temperature. The conversion of monomer to polymer was in excess of 98.5%.

The polymer of timing layer Example #9 was prepared as follows:

To a solution of 22 g. (0.5 moles) of polyvinyl alcohol in 700 cc of distilled water was added 90 g. (0.7 moles) of butyl acrylate, 40 g. (0.4 moles) of methyl methacrylate, and 20 g (0.16 moles) of 2-cyanoethyl acrylate. The pH of the mixture was adjusted to 1.5 with concentrated nitric acid. The stirred mixture was deaerated with nitrogen for an hour. After deaeration was complete, 13 g. of the surfactant, Abex 265, was added. Stirring was continued until the surfactant dissolved completely. With the nitrogen passing over the solution, 4 g of ceric ammonium nitrate dissolved in 20 cc of water was added. Stirring was continued for two hours. Conversion of monomer to polymer was in excess of 98.5%.

The test elements, Examples 8 and 9, were evaluated in the manner set forth in connection with the test elements of Examples 1 to 4 with the following results:

| | Clearing times (start-finish) sec | | |
|---|---|---|---|
| Gap (inches) | Standard #2 | Example #8 | Example #9 |
| 0.0036 | 255–307 | 500–710 | 120–210 |
| 0.0028 | 180–222 | 553–730 | 130–195 |
| 0.0022 | 138–173 | 601–748 | 140–195 |

The test elements, Examples 8 and 9, were evaluated in the manner set forth in connection with Example 5 with the following results:

| Experiment | Clearing Time Start (sec.) | Clearing Time Finish (sec.) |
|---|---|---|
| 5A Test (Example #8) | 840 | 1380 |
| 5A Conventional (Std #2) | 28 | 41 |
| 5A Test (Example #9) | 208 | 368 |
| 5B Test (Example #8) | 553 | 730 |
| 5B Conventional (Std #2) | 180 | 222 |
| 5B Test (Example #9) | 130 | 195 |

The above illustrates that the graft copolymer timing layers of Examples 8 and 9 exhibit appreciable "hold release" characteristics and the capacity to control the permeation properties thereof by changing alkali concentration.

Since certain changes may be made in the above product without departing from the scope of the invention herein involved, it is intended that all matter contained in the above description and shown in the accompanying drawings shall be interpreted as illustrative and not in a limiting sense.

What is claimed is:

1. A photographic diffusion transfer film unit comprising:

a. a photosensitive element comprising at least a photosensitive silver halide emulsion layer having associated therewith a processing composition soluble and diffusible image-forming material;

b. an image-receiving element;

c. means for discharging an alkaline processing composition within said film unit; and d. a diffusion control layer in at least one of said photosensitive element or said image-receiving element;

said diffusion control layer comprising a graft copolymer comprising an organic polymeric backbone having grafted thereon recurring units from a hydrophobic monomer and recurring units from a monomer capable of undergoing $\beta$-elimination in an alkaline environment and having the formula

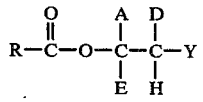

wherein R is an ethylenically unsaturated alkyl radical of from 2 to 5 carbon atoms; A, E and D are each selected from the group consisting of hydrogen, methyl and phenyl, provided that no more than one of A, E and D is methyl or phenyl; and Y is an activating group.

2. The photographic diffusion transfer film unit of claim 1 wherein said photosensitive element comprises at least two silver halide emulsion layers having associated therewith a processing composition soluble and diffusible image-forming material and said diffusion control layer comprises an interlayer positioned between said silver halide emulsion layers.

3. The photographic diffusion transfer film unit of claim 1 wherein said diffusion control layer comprises an overcoat in said photosensitive element.

4. The photographic diffusion transfer film unit of claim 1 wherein said diffusion control layer is present in said image-receiving element.

5. The photographic diffusion transfer film unit of claim 4 wherein said diffusion control comprises a timing layer of said image-receiving element.

6. The photographic diffusion transfer film unit of claim 4 wherein said diffusion control layer comprises an overcoat in said image-receiving element.

7. The film unit of claim 1 wherein said image-forming material is a dye developer.

8. The film unit of claim 1 wherein said activating group is selected from the group consisting of:

$-SO_2W$, $$-\overset{O}{\overset{\|}{C}}-T,\ -\overset{O}{\overset{\|}{S}}-G,$$

—CN, and $-NO_2$ where

W is $-C_6H_5CH_3$, $-CH_3$, $-OC_2H_5$, $-C_6H_5$, $-NR_2$—$N(CH_2C_6H_5)_2$;

T is $-OC_2H_5$, $-CH_3$, —H, $-NH_2$, $-NR_2$;

G is phenyl, methyl or ethyl; and

R is methyl or ethyl.

9. The film unit of claim 1 wherein said β-elimination monomer comprises 2-cyano-ethyl acrylate.

10. The film unit of claim 1 wherein said β-elimination monomer comprises 2-cyano-ethyl methacrylate.

11. The film unit of claim 1 wherein said β-elimination monomer comprises 2-carbethoxy-ethyl methacrylate.

12. The film unit of claim 1 wherein said units from said β-elimination monomer comprise from about 2 to about 30% by weight of said graft copolymer.

13. The film unit of claim 12 wherein said units from said hydrophobic monomer comprise from about 50% to about 90% by weight of said graft copolymer.

14. The film unit of claim 13 wherein said hydrophobic monomer is selected from the group consisting of diacetone acrylamide, alkyl acrylates, alkyl methacrylates and mixtures thereof.

15. The film unit of claim 14 wherein said organic polymeric backbone comprises a backbone selected from the group consisting of cellulose polymers, vinyl polymers and gelatin.

16. The film unit of claim 15 wherein said organic polymeric backbone comprises polyvinyl alcohol.

17. A photosensitive element for use in diffusion transfer photographic processes comprising:

a support layer;

at least two selectively sensitized silver halide emulsion layers coated upon said support, each emulsion layer having associated therewith a processing composition soluble and diffusible image-forming material; and an interlayer positioned between at least two of said silver halide emulsion layers, which interlayer comprises a graft copolymer comprising an organic polymeric backbone having grafted thereon recurring units from a hydrophobic monomer and recurring units from a monomer capable of undergoing β-elimination in an alkaline environment and having the formula $$R-\overset{O}{\overset{\|}{C}}-O-\underset{E}{\overset{A}{C}}-\underset{H}{\overset{D}{C}}-Y$$

wherein R is an ethylenically unsaturated alkyl radical of from 2 to 5 carbon atoms; A, E and D are each selected from the group consisting of hydrogen, methyl and phenyl, provided that no more than one of A, E and D is methyl or phenyl; and Y is an activating group.

18. The photosensitive element of claim 17 wherein said image-forming material is a dye developer.

19. The photosensitive element of claim 17 wherein said activating group is selected from the group consisting of:

$-SO_2W$, $$-\overset{O}{\overset{\|}{C}}-T,\ -\overset{O}{\overset{\|}{S}}-G,$$

—CN, and $-NO_2$ where

W is $-C_6H_5CH_3$, $-CH_3$, $-OC_2H_5$, $-C_6H_5$, $-NR_2$—$N(CH_2C_6H_5)_2$;

T is $-OC_2H_5$, $-CH_3$, —H, $-NH_2$, $-NR_2$;

G is phenyl, methyl or ethyl; and

R is methyl or ethyl.

20. The photosensitive element of claim 17 wherein said β-elimination monomer comprises 2-cyano-ethyl acrylate.

21. The photosensitive element of claim 17 wherein said β-elimination monomer comprises 2-cyano-ethyl methacrylate.

22. The photosensitive element of claim 17 wherein said β-elimination monomer comprises 2-carbethoxy-ethyl methacrylate.

23. The photosensitive element of claim 17 wherein said units from said β-elimination monomer comprise from about 2 to about 30% by weight of said graft copolymer.

24. The photosensitive element of claim 23 wherein said units from said hydrophobic monomer comprise from about 50% to about 90% by weight of said graft copolymer.

25. The photosensitive element of claim 24 wherein said hydrophobic monomer is selected from the group consisting of diacetone acrylamide, alkyl acrylates, alkyl methacrylates and mixtures thereof.

26. The photosensitive element of claim 25 wherein said organic polymeric backbone comprises a backbone selected from the group consisting of cellulosic polymers, vinyl polymers and gelatin.

27. The photosensitive element of claim 26 wherein said organic polymeric backbone comprises polyvinyl alcohol.

28. A photosensitive element for use in diffusion transfer photographic processes comprising:

a support layer;

at least a photosensitive silver halide emulsion layer coated upon said support, said emulsion layer having associated therewith a processing composition soluble and diffusible image-forming material; and an overcoat comprising a graft copolymer comprising an organic polymeric backbone having grafted thereon recurring units from a hydrophobic monomer and recurring units from a monomer capable of undergoing $\beta$-elimination in an alkaline environment and having the formula

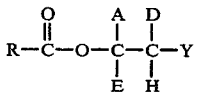

wherein R is an ethylenically unsaturated alkyl radical of from 2 to 5 carbon atoms; A, E and D are each selected from the group consisting of hydrogen, methyl and phenyl provided that no more than one of A, E and D is methyl, or phenyl; and Y is an activating group.

29. The photosensitive element of claim 28 wherein said image-forming material is a dye developer.

30. The photosensitive element of claim 28 wherein said activating group is selected from the group consisting of:

$-SO_2W$,

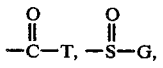

—CN, and $-NO_2$ where

W is $-C_6H_5CH_3$, $-CH_3$, $-OC_2H_5$, $-C_6H_5$, $-NR_2$, $-N(CH_2C_6H_5)_2$;

T is $-OC_2H_5$, $-CH_3$, —H, $-NH_2$, $-NR_2$;

G is phenyl, methyl or ethyl; and

R is methyl or ethyl.

31. The photosensitive element of claim 28 wherein said $\beta$-elimination monomer comprises 2-cyano-ethyl acrylate.

32. The photosensitive element of claim 28 wherein said $\beta$-elimination monomer comprises 2-cyano-ethyl methacrylate.

33. The photosensitive element of claim 28 wherein said $\beta$-elimination monomer comprises 2-carbethoxy-ethyl methacrylate.

34. The photosensitive element of claim 28 wherein said units from said $\beta$-elimination monomer comprises from about 2 to about 30% by weight of said graft copolymer.

35. The photosensitive element of claim 34 wherein said units from said hydrophobic monomer comprise from about 50% to about 90% by weight of said graft copolymer.

36. The photosensitive element of claim 35 wherein said hydrophobic monomer is selected from the group consisting of diacetone acrylamide, alkyl acrylates, alkyl methacrylates and mixtures thereof.

37. The photosensitive element of claim 36 wherein said organic polymeric backbone comprises a backbone selected from the group consisting of cellulosic polymers, vinyl polymers and gelatin.

38. The photosensitive element of claim 37 wherein said organic polymeric backbone comprises polyvinyl alcohol.

39. A photographic film unit comprising in combination a photosensitive element and a diffusion transfer image-receiving element, said combination comprising:

a support layer;

at least two selectively sensitized silver halide emulsion layers coated upon said support each emulsion layer having associated therewith a processing composition soluble and diffusible image-forming material;

an interlayer positioned between at least two of said silver halide emulsion layers, which interlayer comprises a graft copolymer comprising an organic polymeric backbone having grafted thereon recurring units from a hydrophobic monomer and recurring units from a monomer capable of undergoing $\beta$-elimination in an alkaline environment and having the formula

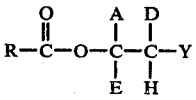

wherein R is an ethylenically unsaturated alkyl radical of from 2 to 5 carbon atoms; A, E and D are each selected from the group consisting of hydrogen, methyl and phenyl, provided that no more than one of A, E and D is methyl or phenyl; and Y is an activating group; and an alkaline processing composition permeable and dyeable image-receiving layer.

40. The film unit of claim 39 wherein said image-forming material is a dye developer.

41. The film unit of claim 39 wherein said activating group is selected from the group consisting of:

$-SO_2W$,

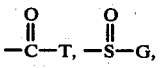

—CN, and $-NO_2$ where

W is $-C_6H_5CH_3$, $-CH_3$, $-OC_2H_5$, $-C_6H_5$, $-NR_2$—$N(CH_2C_6H_5)_2$;

T is $-OC_2H_5$, $-CH_3$, —H, $-NH_2$, $-NR_2$;

G is phenyl, methyl or ethyl; and

R is methyl or ethyl.

42. The photographic film unit of claim 39 wherein said $\beta$-elimination monomer comprises 2-cyano-ethyl acrylate.

43. The photographic film unit of claim 39 wherein said $\beta$-elimination monomer comprises 2-cyano-ethyl methacrylate.

44. The photographic film unit of claim 39 wherein said $\beta$-elimination monomer comprises 2-carbethoxy-ethyl methacrylate.

45. The photographic film unit of claim 39 wherein said units from said $\beta$-elimination monomer comprises from about 2 to about 30% by weight of said graft copolymer.

46. The photographic film unit of claim 45 wherein said units from said hydrophobic monomer comprise from about 50% to about 90% by weight of said graft copolymer.

47. The photographic film unit of claim 46 wherein said hydrophobic monomer is selected from the group consisting of diacetone acrylamide, alkyl acrylates, alkyl methacrylates and mixtures thereof.

48. The photographic film unit of claim 47 wherein said organic polymeric backbone comprises a backbone selected from the group consisting of cellulosic polymers, vinyl polymers and gelatin.

49. The photographic film unit of claim 48 wherein said organic polymeric backbone comprises polyvinyl alcohol.

50. An image-receiving element for use in diffusion transfer photographic processes comprising:

a support layer, a polymeric acid layer, a polymeric layer comprising a graft copolymer comprising organic polymeric backbone having grafted thereon recurring units from a hydrophobic monomer and recurring units from a monomer capable of undergoing $\beta$-elimination in an alkaline environment, said graft copolymer being substantially impermeable to processing composition until said $\beta$-elimination occurs, said monomer capable of said $\beta$-elimination having the formula

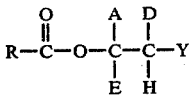

wherein R is an ethylenically unsaturated alkyl radical of from 2 to 5 carbon atoms; A, E and D are each selected from the group consisting of hydrogen, methyl and phenyl, provided that no more than one of A, E and D is methyl or phenyl; and Y is an activating group; and an alkali permeable and dyeable image-receiving layer.

51. The image-receiving element of claim 50 wherein said activating group is selected from the group consisting of $-SO_2W$,

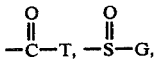

—CN, and $-NO_2$ where

W is $-C_6H_5CH_3$, $-CH_3$, $-OC_2H_5$, $-NR_2$, $-N(CH_2C_6H_5)_2$;

T is $-OC_2H_5$, $-CH_3$, —H, $-NH_2$, $-NR_2$,

G is phenyl, methyl or ethyl, and

R is methyl or ethyl.

52. The image-receiving element of claim 50 wherein said $\beta$-elimination monomer comprises 2-cyano-ethyl acrylate.

53. The image-receiving element of claim 50 wherein said $\beta$-elimination monomer comprises 2-cyano-ethyl methacrylate.

54. The image-receiving element of claim 50 wherein said $\beta$-elimination monomer comprises 2-carbethoxy-ethyl methacrylate.

55. The image-receiving element of claim 50 wherein said units from said $\beta$-elimination monomer comprise from about 2 to about 30% by weight of said graft copolymer.

56. The image-receiving element of claim 50 wherein said units from said hydrophobic monomer comprise from about 50% to about 90% by weight of said graft copolymer.

57. The image-receiving element of claim 56 wherein said hydrophobic monomer is selected from the group consisting of diacetone acrylamide, alkyl acrylates, alkyl methacrylates and mixtures thereof.

58. The image-receiving element of claim 57 wherein said organic polymeric backbone comprises a backbone selected from the group consisting of cellulosic polymers, vinyl polymers and gelatin.

59. The image-receiving element of claim 58 wherein said organic polymeric backbone comprises polyvinyl alcohol.

* * * * *